US008590427B2

(12) United States Patent
Murphy et al.

(10) Patent No.: US 8,590,427 B2
(45) Date of Patent: Nov. 26, 2013

(54) BLADE STORAGE DEVICE INCLUDING A BLADE SHARPENER AND A HONING DEVICE

(75) Inventors: Rosemary Murphy, Kingsgrove (AU); Clive Solari, Paddington (GB)

(73) Assignee: McPherson's Limited, Mulgrave, Victoria (AU)

( * ) Notice: Subject to any disclaimer, the term of this patent is extended or adjusted under 35 U.S.C. 154(b) by 0 days.

(21) Appl. No.: 13/379,238

(22) PCT Filed: Jun. 22, 2010

(86) PCT No.: PCT/AU2010/000770

§ 371 (c)(1),
(2), (4) Date: Feb. 23, 2012

(87) PCT Pub. No.: WO2010/148430

PCT Pub. Date: Dec. 29, 2010

(65) Prior Publication Data

US 2012/0180602 A1 Jul. 19, 2012

(30) Foreign Application Priority Data

Jun. 22, 2009 (AU) ..... 2009902865

(51) Int. Cl.
*B21K 5/12* (2006.01)
*B26B 29/02* (2006.01)

(52) U.S. Cl.
USPC ..... 76/82; 30/138; 30/143; 30/151; 30/298.4; 206/349

(58) Field of Classification Search
USPC ..... 30/138, 142, 143, 151, 298.4; 76/82; 7/120; D8/93; D3/20; 206/349, 379; 211/70.7; 451/555; 224/232–234
See application file for complete search history.

(56) References Cited

U.S. PATENT DOCUMENTS

| | | | | | |
|---|---|---|---|---|---|
| D140,745 | S | * | 4/1945 | Fairbairn et al. | D3/220 |
| 2,767,530 | A | * | 10/1956 | Paldanius | 30/138 |
| 2,826,879 | A | * | 3/1958 | Evans | 451/555 |
| 3,307,756 | A | * | 3/1967 | Brunosson et al. | 224/232 |
| 3,576,278 | A | * | 4/1971 | Eastman | 224/232 |
| D225,559 | S | * | 12/1972 | Bayly | D3/220 |
| 3,760,438 | A | | 9/1973 | White | |
| D232,899 | S | * | 9/1974 | Bayly | D8/93 |

(Continued)

FOREIGN PATENT DOCUMENTS

| | | | |
|---|---|---|---|
| CA | 2765751 | A1 * | 12/2010 |
| CN | 102497957 | A * | 6/2012 |

(Continued)

OTHER PUBLICATIONS

International Search Report dated Oct. 7, 2010 for International Application No. PCT/AU2010/000770 (5 pages).

(Continued)

*Primary Examiner* — Jason Daniel Prone
(74) *Attorney, Agent, or Firm* — Hovey Williams LLP

(57) ABSTRACT

A housing including a honing device, a blade sharpener, a blade restraining mechanism, and a biased blade guide being received in a scabbard or a knife block. Wherein a knife is honed and sharpened upon insertion into the housing, or upon withdrawal from the housing, or both, and wherein the blade is retained within the housing after insertion therein.

14 Claims, 8 Drawing Sheets

(56) References Cited

U.S. PATENT DOCUMENTS

| | | | | | |
|---|---|---|---|---|---|
| 4,041,651 | A | | 8/1977 | Bayly | |
| 4,091,691 | A | | 5/1978 | Bayly | |
| D265,147 | S | * | 6/1982 | Jackson | D3/220 |
| 4,348,809 | A | * | 9/1982 | Jackson | 30/138 |
| 4,426,779 | A | * | 1/1984 | Morgan | 30/138 |
| 4,428,515 | A | * | 1/1984 | Mayer | 224/232 |
| 4,495,696 | A | * | 1/1985 | Fethke et al. | 30/138 |
| 4,502,218 | A | * | 3/1985 | Carter et al. | 30/138 |
| 4,718,200 | A | * | 1/1988 | Miquelot | 76/82 |
| D295,132 | S | * | 4/1988 | Blochlinger et al. | D3/220 |
| 4,866,845 | A | | 9/1989 | McEvily | |
| D303,731 | S | * | 10/1989 | Blochlinger et al. | D3/220 |
| 5,138,768 | A | | 8/1992 | Collins | |
| D334,791 | S | * | 4/1993 | Collins | D3/220 |
| 5,494,176 | A | * | 2/1996 | Zallo | 211/70.7 |
| D374,981 | S | * | 10/1996 | Hainsworth et al. | D3/220 |
| D421,706 | S | * | 3/2000 | Lion et al. | D8/93 |
| D424,906 | S | * | 5/2000 | May et al. | D3/220 |
| 6,101,898 | A | * | 8/2000 | Gore et al. | 76/82 |
| 6,224,475 | B1 | * | 5/2001 | May et al. | 451/555 |
| D448,931 | S | * | 10/2001 | Gutierrez et al. | D8/93 |
| 6,643,934 | B2 | * | 11/2003 | Pope | 30/138 |
| D488,980 | S | * | 4/2004 | Bradshaw | D8/93 |
| 6,752,702 | B1 | | 6/2004 | Thompson et al. | |
| 7,175,023 | B2 | * | 2/2007 | Martin | 30/151 |
| 7,841,093 | B1 | * | 11/2010 | Brady et al. | 30/298.4 |
| 8,117,754 | B2 | * | 2/2012 | Lion et al. | 30/138 |
| D672,549 | S | * | 12/2012 | McLean | D3/220 |
| 2011/0289782 | A1 | * | 12/2011 | Murphy et al. | 30/138 |
| 2012/0266468 | A1 | * | 10/2012 | Murphy et al. | 30/298.4 |

FOREIGN PATENT DOCUMENTS

| | | | | |
|---|---|---|---|---|
| EP | 2493657 | A1 | * | 9/2012 |
| JP | 60150953 | A | | 8/1985 |
| SG | 177352 | A1 | * | 2/2012 |
| WO | WO 2010042984 | A1 | * | 4/2010 |
| WO | WO 2010148430 | A1 | * | 12/2010 |

OTHER PUBLICATIONS

International Preliminary Report on Patentability dated Oct. 19, 2011 for International Application No. PCT/AU2010/000770 (21 pages).

* cited by examiner

BLADE STORAGE DEVICE INCLUDING A BLADE SHARPENER AND A HONING DEVICE

RELATED APPLICATIONS

This application is a national stage submission under 35 U.S.C. 371 of International Patent Application No. PCT/AU2010/000770, filed Jun. 22, 2010, which claims the priority of Australian Patent Application No. 209902865, filed Jun. 22, 2009, both of which are hereby incorporated by reference in their entirety.

FIELD OF THE INVENTION

The present invention relates to the field of blade sharpeners and blade scabbards and is particularly but not exclusively concerned with knife blade sharpeners and scabbards. The present invention is described herein with reference to knife blade scabbards incorporating a mechanism for sharpening the blade cutting edge and with reference to a sharpening cassette for sharpening a blade cutting edge.

BACKGROUND OF THE INVENTION

Blades such as knives or scissors are frequently stored in a scabbard or block when not in use. Some scabbards and knife blocks can include a sharpening mechanism which is operable when the blade is inserted or removed from the scabbard or block to sharpen the blade for subsequent use. However, such sharpening mechanisms are typically abrasive and do not provide a fine finish to the cutting edge of the blade.

It would therefore be desirable to provide a blade scabbard incorporating a blade sharpening mechanism that is operable for sharpening the cutting edge of a blade which also provides a fine finish to the cutting edge. It would also be desirable to provide a blade sharpening cassette incorporating a blade sharpening mechanism that is operable for sharpening the cutting edge of a blade which also provides a fine finish to the cutting edge and which can be provided in a knife block.

SUMMARY OF THE INVENTION

The present invention provides, in a first aspect, a blade sharpening and storing device including:

- a hollow housing for receiving and storing a blade;
- an access opening at an end of the housing through which the blade can be moved longitudinally to be inserted into or withdrawn from the housing;
- a blade sharpener positioned to be engaged by a cutting edge of the blade when the blade is inserted into or withdrawn from the housing and which is responsive to movement of the blade relative to the housing to sharpen the cutting edge; and
- a blade honing device positioned to be engaged by the cutting edge of the blade when the blade is inserted into or withdrawn from the housing and which is responsive to movement of the blade relative to the housing to hone the cutting edge.

The invention is advantageous in that in addition to sharpening the cutting edge of the blade as it is inserted into or removed from the housing of the blade sharpening device the invention also hones the cutting edge of the blade which results in a sharper cutting edge. Thus, the blade sharpening device provides the blade with better characteristics for the purpose of cutting than previous blade sharpening devices.

Furthermore, the present invention is advantageous in that it provides a device which simultaneously sharpens and hones the cutting edge of a blade.

In one form, the blade honing device is positioned relative to the blade sharpener so as to hone a portion of the cutting edge blade after the sharpener sharpens the portion of the cutting edge of the blade upon withdrawal of the blade from the housing.

The above form of the invention is advantageous in that it hones a portion of the cutting edge after the portion is sharpened to thereby provide the blade with a sharpened cutting edge with a honed finish for subsequent use of the blade.

In yet another form, the honing device is positioned between the blade sharpener and the access opening.

The above forms of the invention are advantageous in that by sharpening and honing the cutting edge upon withdrawal the blade is provided with a sharpened cutting edge with a honed finish when the blade is withdrawn from the blade sharpening device for use.

In one form, the honing device includes a pair of honing members each having a honing surface and being arranged so that there is an overlap between the honing members and a generally v-shaped honing recess formed between the two honing surfaces for receiving the cutting edge of the blade wherein said honing surfaces are operative to hone the cutting edge of the blade upon movement of the blade within the honing recess relative to the honing surfaces.

The above form of the invention is advantageous in that it provides effective honing of the cutting edge of the blade in a device that is safe and convenient to use. Furthermore, the v-shaped configuration of the honing recess formed between the honing surfaces directs the cutting edge of the blade into engagement with both honing surfaces to hone opposite sides of the cutting edge simultaneously and in a reliable, repeatable and effective manner.

In one form, the honing members are arranged in substantially parallel relationship and the honing surfaces are curved in transverse cross section.

In another form, the honing device includes a honing support member supporting the honing members, the honing support member is mounted to the housing and is biased so that upon movement of the blade relative to the housing the cutting edge of the blade is maintained within the honing recess and in engagement with the honing surfaces.

In yet another form, the honing device is configured to hone the blade only upon withdrawal of the blade from the housing.

The above form of the invention is advantageous in that it does not needlessly hone the cutting edge of the blade prior to sharpening. Thus, by not needlessly honing the blade upon numerous insertions and removals of the blade from the sharpening device the above form of the invention helps prolong the effective life of the blade and/or the honing device.

In one form, the blade sharpening device further includes a blade restraining mechanism that includes a restraining member coupled to the housing and an opening within the blade, the restraining member being movable relative to the housing between active and inactive positions in that when the blade is inserted within the housing such that substantially the entire cutting edge of the blade is within the housing, in the active position the restraining member is positioned inside the opening within the blade for preventing withdrawal of the blade from the housing and in the inactive position the restraining member is positioned outside the opening within the blade for allowing withdrawal of the blade from the housing.

The above form of the invention is advantageous in that it provides an effective and reliable means for restraining the blade within the housing and preventing inadvertent withdrawal therefrom.

In one form, the restraining member is biased towards the active position and is configured so that during insertion of the blade into the housing the blade engages and actuates the restraining member to the inactive position until the blade is inserted sufficiently within the housing such that the opening meets the restraining member which is then biased to the active position.

The above form of the invention is advantageous in that by biasing the restraining member to the active position the blade is automatically restrained upon insertion within the housing and does not require an additional step or action on behalf of the user to ensure that the blade is effectively restrained.

In another form, the restraining member includes a projection which extends transversely to the direction of insertion of the blade into the housing and has a straight surface and a sloping surface, wherein the sloping surface is engaged by the blade upon insertion into the housing to actuate the restraining member to the inactive position and wherein the straight surface engages the opening within the blade when the restraining member is in the active position to prevent withdrawal of the blade from the housing.

By engaging the opening within the blade the straight surface of the projection abuts against a surface surrounding the opening to positively restrain the blade within the housing and prevent inadvertent withdrawal therefrom.

In one form, the restraining mechanism is operable by hand to actuate the restraining member from the active position to the inactive position.

The above form of the invention is advantageous in that it provides a convenient and easy to use mechanism for deactivating the restraining mechanism and releasing the blade from the housing when required for use.

In another form, the blade sharpener includes a pair of sharpening members each having a pair of opposite front and rear surfaces and a transverse surface extending between and meeting the front and rear surfaces, the sharpening members being arranged to overlap to form a generally v-shaped sharpening recess between the transverse surfaces for receiving the cutting edge of the blade wherein each of the transverse surfaces meets at least one of the front and rear surfaces at a sharp corner wherein the sharp corner is operable to sharpen the cutting edge of the blade upon movement of the blade within the sharpening recess relative to the sharpening members.

In one form, the sharpening members are arranged in substantially parallel relationship.

In another form, the blade sharpener further includes a sharpener support member to which the sharpening members and a roller are mounted, the sharpener support member is pivotally mounted to the housing so that upon insertion of the blade the sharpener support member pivots in one direction so that both the sharpening members and the roller engage the cutting edge of the blade and upon withdrawal of the blade the sharpener support member pivots in an opposite direction so that only the roller disengages the cutting edge of the blade.

In yet another form, the blade sharpening device includes a blade guide that is configured to receive the blade upon insertion into the housing, the blade guide is configured to bias the cutting edge of the blade into engagement with the blade sharpener and the blade honing device when the blade is inserted into or withdrawn from the housing.

In one form, the blade guide includes a pair of opposing guide surfaces defining a slot therebetween for receiving and guiding movement of the blade in a linear direction when the blade is inserted into or withdrawn from the housing.

In a second aspect, the invention provides a blade sharpening and storing device of the first aspect of the invention, and forms thereof, set out above, wherein the housing is incorporated in a blade scabbard.

The above aspect of the invention is advantageous in that it provides a blade sharpening and storing device in the form of a scabbard which is useful for storing the blade when not in use and thereby protecting the blade from damage and also reducing the possibility of injury due to inadvertent contact with the cutting edge of the blade. The blade scabbard is advantageous in that it incorporates a mechanism for sharpening the cutting edge of a blade as well as a mechanism for honing the cutting edge of the blade and which can be inserted and removed from a knife In a third aspect, the invention provides a blade sharpening cassette including the blade sharpening and storing device of the first aspect of the invention, and forms thereof, set out above.

The above aspect of the invention is advantageous in that it provides a blade sharpening and storing device including a sharpening cassette which incorporates a mechanism for sharpening the cutting edge of a blade as well as a mechanism for honing the cutting edge of the blade and which can be inserted and removed from a knife block or another knife storage device. Also, one or more such sharpening cassettes may be mounted in a single knife block for storing, sharpening and honing one or more knives or scissors or other blades with cutting edges requiring sharpening.

In a fourth aspect, the invention provides a blade sharpening and storing device of the first aspect of the invention, and forms thereof, set out above wherein the housing is incorporated in a knife block.

In a fifth aspect, the present invention provides a blade storing device and blade combination, the blade including opposite substantially parallel sides which meet at a cutting edge, the blade storing device including a housing having an access opening at an end of the housing through which the blade can be moved longitudinally to be inserted into or withdrawn from the housing, and a blade restraining mechanism that includes a restraining member coupled to the housing and an opening within the blade, the restraining member having active and inactive positions in that when the blade is inserted within the housing such that substantially an entire cutting edge of the blade is within the housing, in the active position the restraining member is positioned inside the opening within the blade for preventing withdrawal of the blade from the housing and in the inactive position the restraining member is positioned outside the opening within the blade for allowing withdrawal of the blade from the housing.

The above aspect of the invention is advantageous in that it provides an effective and reliable means for storing a blade within a housing and restraining the blade within the housing and preventing inadvertent withdrawal therefrom. The invention is also advantageous in that by providing the opening within the blade the overall structural integrity of the blade is not compromised to any significant degree.

In one form, the opening within the blade extends between and transversely to the substantially parallel sides of the blade and is enclosed within the blade.

In another form, the restraining member includes a projection which extends transversely to the direction of insertion of the blade into the housing and has a straight surface and an opposite sloping surface, wherein the sloping surface is engaged by the blade upon insertion into the housing and wherein the straight surface engages the opening within the blade when the restraining member is in the active position to prevent withdrawal of the blade from the housing.

In yet another form, the restraining member is configured to move between the active and inactive positions by movement of the restraining member in a direction substantially transverse to the substantially parallel sides of the blade when the blade is positioned within the housing.

In one form, the restraining member is biased towards the active position and is configured so that during insertion of the blade into the housing the blade engages and actuates the restraining member to the inactive position until the blade is inserted sufficiently within the housing such that the opening meets the restraining member which is then biased to the active position.

In one form, the restraining mechanism is operable by hand to actuate the restraining member from the active position to the inactive position.

The blade storage device can further include a blade sharpener and a blade honing device, the blade sharpener is positioned to be engaged by a cutting edge of the blade when the blade is inserted into or withdrawn from the housing and which is responsive to movement of the blade relative to the housing to sharpen the cutting edge, the blade honing device is positioned to be engaged by the cutting edge of the blade when the blade is inserted into or withdrawn from the housing and which is responsive to movement of the blade relative to the housing to hone the cutting edge.

In a sixth aspect, the invention provides blade scabbard including the blade storing device of the blade storing device and blade combination set out above.

In a seventh aspect, the invention provides a knife block including the blade storing device of the blade storing device and blade combination set out above.

In an eighth aspect, the invention provides a knife including the blade of the blade storing device and blade combination set out above.

DETAILED DESCRIPTION

Figures 1, 2:
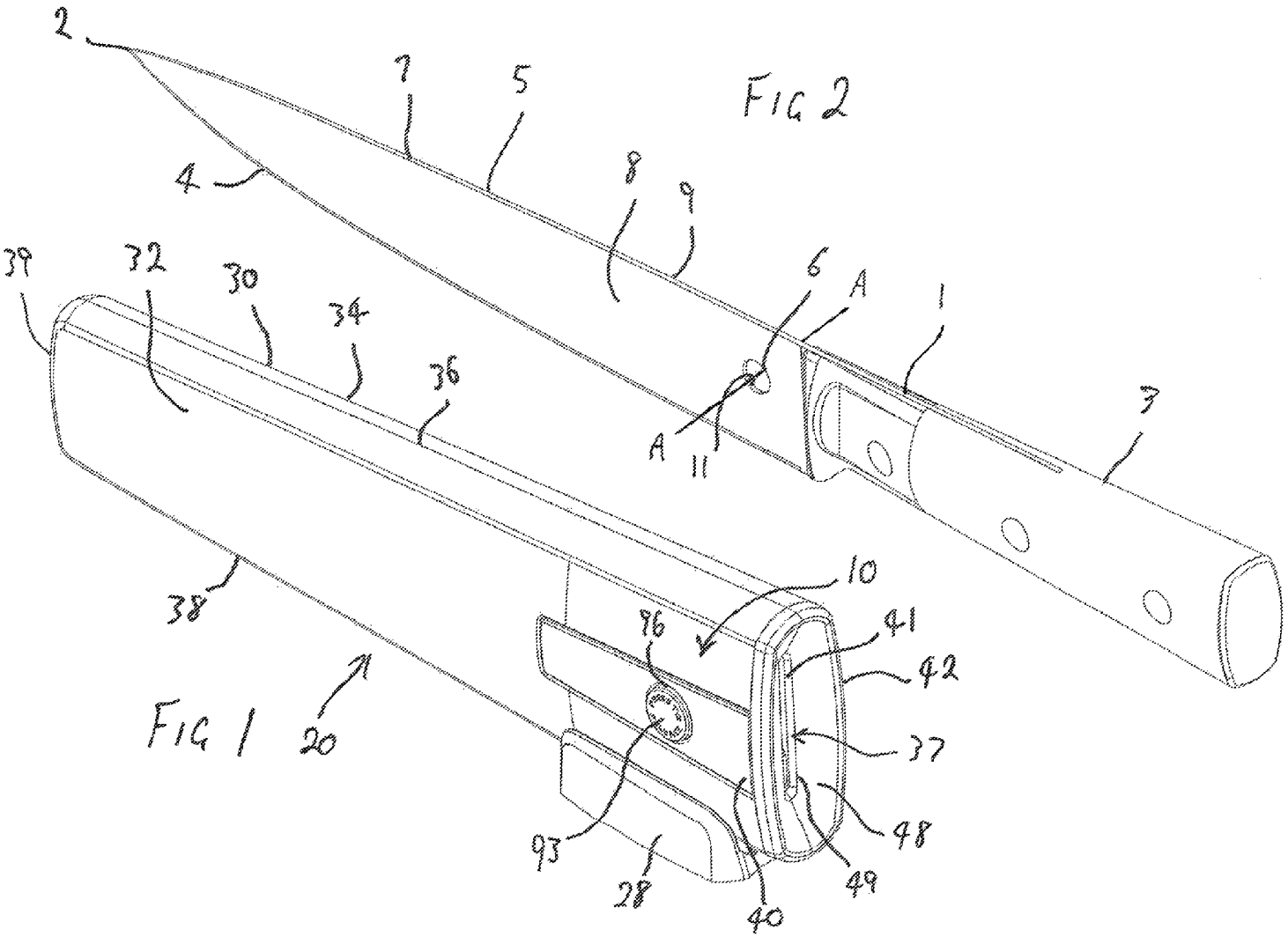
FIG. 1 illustrates an orthogonal view of a blade scabbard including a blade sharpening device in accordance with a preferred form of the invention.
FIG. 2 illustrates an orthogonal view of a knife with a blade in accordance with a preferred form of the invention.

Referring firstly to FIG. 1, there is shown a blade storage device or blade holder in the form of a blade scabbard 20 incorporating a blade sharpening device 10 in accordance with an embodiment of the invention described herein. The blade scabbard 20 includes a main body 30 which is a generally tubular member having a pair of opposite side walls 32, 34, a top wall 36 and a bottom wall 38. The main body 30 has an end wall 39 at one end and an opening 37 at an end opposite to the end wall 39. The blade sharpening device 10 is arranged within the opening 37 within the main body 30. The main body 30 is mounted on a support stand 28 which is configured to support the main body 30 in an upright position on a surface.

Referring to FIG. 2, there is shown a blade 5 which is adapted to be received and held within the blade scabbard 20 of FIG. 1. The blade 5 may be any suitable shape or configuration. In the illustrated embodiments, the blade 5 includes a pair of elongate generally parallel sides 8, 9, a blunt edge 7 and a cutting edge 4 opposite the blunt edge 7. The blade 5 is connected to a handle 3 via a tang 1. The tang 1 is an integral extension of the blade 5. The blunt edge 7 and the cutting edge 4 extend substantially the length of the blade 5 from the tang 1 and the handle 3 to a pointed tip 2. The blade 5 includes an opening 6 between the parallel sides 8, 9 of the blade 5 for reasons that are set out below. The opening 6 is an enclosed opening and extends through the blade 5 between the parallel sides 8, 9 in a direction substantially transverse to the parallel sides 8, 9. Thus, the opening 6 has a central longitudinal axis A-A which runs in a direction substantially transverse to the parallel sides 8, 9. Because the opening 6 is within the blade 5 the opening 6 is enclosed which means that the opening 6 is completely surrounded in a plane transverse to the longitudinal axis A-A of the opening 6 by a surface 11 which is integral with the rest of the blade 5.

As shown in FIGS. 1, 3, 4 and 5 the blade sharpening device 10 includes first and second housing members 40, 42. The first and second housing members 40, 42 provide support for the components of the blade sharpening device 10. The first and second housing members 40, 42 are each in the form of concave members which are configured to be assembled in opposing relation to define a hollow housing 41 for receiving and holding or storing a blade 5 of a knife 2 therewithin. In assembled form, the housing 41 has a forward opening 44 and opposing rearward opening 46, a top wall 21 and opposing bottom wall 22 and opposing first and second side walls 23, 24. The housing 41 is arranged to be positioned within the opening 37 of the main body 30 of the scabbard 20 with the forward opening 44 inserted within the housing 41 forward of the opening 37 and with the rearward opening 46 of the housing 41 arranged to be positioned adjacent to the opening 37. Accordingly, as the blade 5 is inserted within the blade sharpening device 10 and into the main body 30 of the blade scabbard 20 the blade 5 first enters the rearward opening 46 and subsequently passes through the forward opening 44 of the housing 41. Arranged within the housing 41 at the rearward opening 46 is a guide member 48 defining an access opening 49. The access opening 49 is in the form of a linear, vertically extending slot for receiving the blade 5 therethrough.

Mounted within the housing 41 of the sharpening device 10 is a blade sharpener 50 and a honing device 60. The blade sharpener 50 is located a distance spaced apart from the access opening 49 and the honing device 60 is positioned between the blade sharpener 50 and the access opening 49. Thus, as the blade 5 is inserted through the access opening the blade first encounters the honing device 60 and then the blade sharpener 50. In the arrangement illustrated in the figures, the blade sharpener 50 includes a sharpening device 52 pivotally mounted within the housing 41. The sharpening device 52 is positioned closer to the bottom wall 22 than the top wall 21 within the housing 41. The sharpening device 52 includes a sharpener support member 54 having a pair of laterally extending projections 56, 58 which are configured to be received within a pair of opposing apertures 43, 45 in respective ones of the opposing side surfaces 23, 24 of the housing 41. The sharpening device 52 is configured so that with the projections 56, 58 positioned within the apertures 43, 45 the support member 54 pivots back and forth about an axis X-X wherein the axis X-X is in a direction across the opposing side surfaces 23, 24 and transverse to the direction of insertion of the blade 5 within the housing 41.

A pair of sharpening members 51, 65 are mounted to the support member 54. Each of the sharpening members 51, 65 is in the form of a plate having a respective front surface 61, 66, rear surface 62, 67 and a transverse surface 63, 68 extending between the front surface 61, 66 and the rear surface 62, 67 of each sharpening member 51, 65. The transverse surfaces 63, 68 meet the front surface 61, 66 at a sharp edge and also meet the rear surface 62, 67 at a sharp edge. The sharpening members 51, 65 are arranged to overlap to form a generally v-shaped sharpening recess 64 between the transverse surfaces 63, 68 thereof. The sharpening recess 64 is configured to receive a cutting edge 4 of the blade 5. The blade sharpening members 51, 65 may be formed out of any suitable material. In one form, the sharpening members 51, 65 are formed out of a carbide material such as Tungsten Carbide. Also mounted to the support member 54 is a roller 69 which is arranged to engage the cutting edge 4 of the blade 5 in the manner described below.

Figure 5:
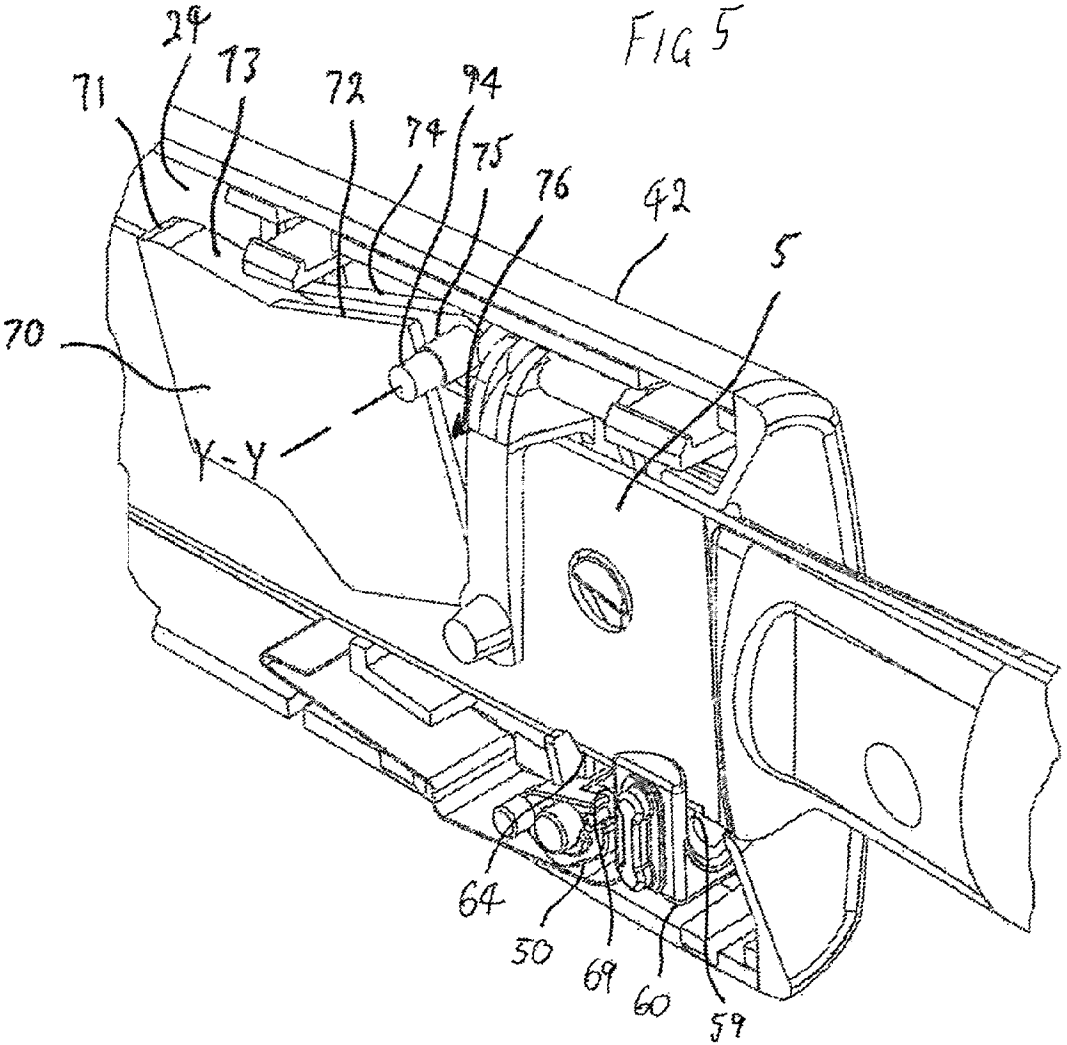
FIG. 5 illustrates an orthogonal cut away view of the blade sharpening device of FIG. 1 illustrating the components of the blade sharpening device including the blade sharpener, the blade honing device, a blade guide and a blade inserted into the blade sharpener and retained therein by a blade restraining mechanism.
Figure 6:
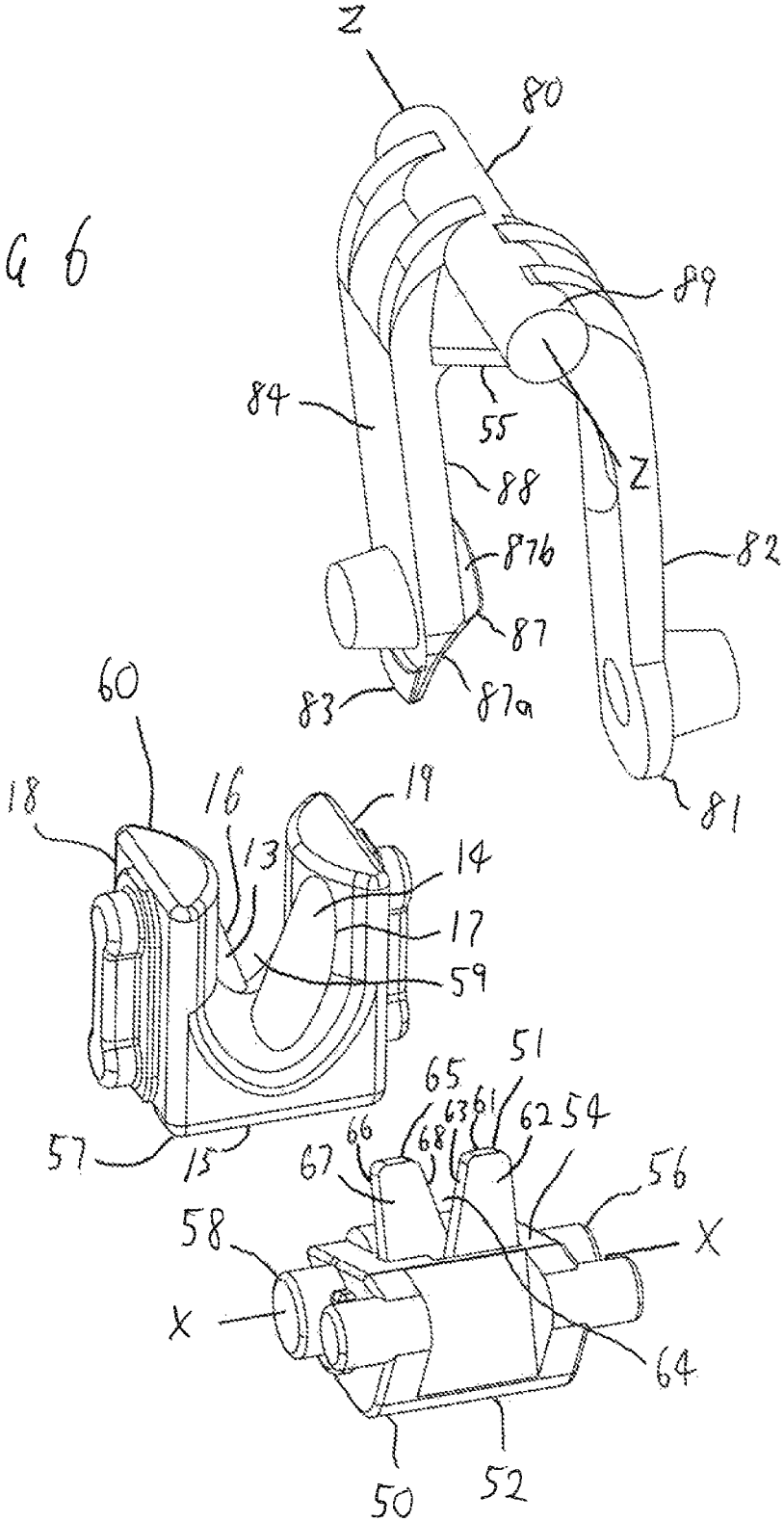
FIG. 6 illustrates an orthogonal view of the blade sharpening device of FIG. 1 illustrating components of the blade sharpening device including a restraining member in the form of an inverted U-shaped member and the blade sharpener and the blade honing device.

In use, as shown in FIG. 5, as the blade 5 is inserted into the housing 41 through the access opening 49 with the cutting edge 4 pointing down towards the bottom wall 22 of the housing 41 the cutting edge 4 is received within the sharpening recess 64 and engages the transverse surfaces 63, 68 of the sharpening members 51, 65. As the blade 5 is progressively inserted further through the access opening 49 and into the housing 41 the cutting edge 4 slides over the transverse surfaces 63, 68 of the sharpening member 51, 65 which causes the sharpening support member 54 to pivot about the axis X-X in a forward direction which is the direction of insertion of the blade 5 into the housing 41. When the sharpening support member 54 pivots in the forward direction the edges of the sharpening members 51, 65 at which the transverse surfaces 63, 68 meet the front surfaces 61, 66 present a sharp v-shaped sharpening recess for sharpening the cutting edge 4 of the blade 5 upon insertion of the blade 5 into the housing 41. Also, when the sharpening support member 54 pivots in the forward direction the roller 69 is also brought into engagement with the cutting edge 4 of the blade 5 to assist smooth movement of the blade 5 within the sharpening recess 64 whilst in engagement with the transverse surfaces 63, 68 of the sharpening members 51, 65. Upon withdrawal of the blade 5 from within the housing 41 the sharpener support member 54 pivots in an opposite rearward direction so that the roller 69 disengages the cutting edge 4 of the blade 5. When the sharpening support member 54 pivots in the rearward direction the edges of the sharpening members 51, 65 at which the transverse surfaces 63, 68 meet the rear surfaces 62, 67 present a sharp v-shaped sharpening recess for sharpening the cutting edge 4 of the blade 5 upon withdrawal of the blade 5 from within the housing 41.

Referring to FIGS. 3 to 6, the honing device 60 includes a pair of honing members 16, 17. The honing device 60 is positioned closer to the bottom wall 22 than the top wall 21 within the housing 41. Each of the honing members 16, 17 is an elongate member having a curved lateral honing surface 13, 14. The honing members 16, 17 are arranged in a generally parallel relationship such that there is an overlap between the honing members 16, 17 and so as to form a generally v-shaped honing recess 59 between the honing surfaces 13, 14. As shown in FIG. 5, the honing recess 59 is configured to receive the cutting edge 4 of the blade 5 upon insertion and withdrawal of the blade 5 through the access opening 49 and within the housing 41 of the blade sharpening device 10. The honing members 16, 17 are mounted in a honing member support 57. The honing member support 57 includes a base portion 15 and a pair of upwardly extending arms 18, 19 extending from the base 15 to form a generally U-shaped member with an open end oriented in a generally upwards direction within the housing 41. Each of the honing members 16, 17 extends between the base 15 and a respective one of the arms 18, 19 and is supported therebetween. The base 15 of the honing member support 57 is mounted on a plate spring member 77. One end 78 of the plate spring member 77 is fixed to a coupling member 97 integrally formed with the side walls 23, 24 of the housing 41. An opposite free end 86 of the plate spring member 77 is configured for connection with the base 15 of the honing member support 57. The plate spring member 77 is configured to bias the honing member support 57 vertically upwards within the housing 41. Accordingly, upon insertion and withdrawal of the blade 5 into the housing 41 the honing device 60 is biased by the plate spring member 77 so as to cause the blade 5 to be positioned within the honing recess 59 wherein the cutting edge 4 of the blade 5 is engaged by the honing surfaces 13, 14. Movement of the blade 5 within the honing recess 59 and relative to the honing surfaces 13, 14 hones the cutting edge 4 of the blade 5. The honing members 16, 17 may be made out of any suitable material. In one form, the honing members 16, 17 are formed out of ceramic rods.

Figure 3:
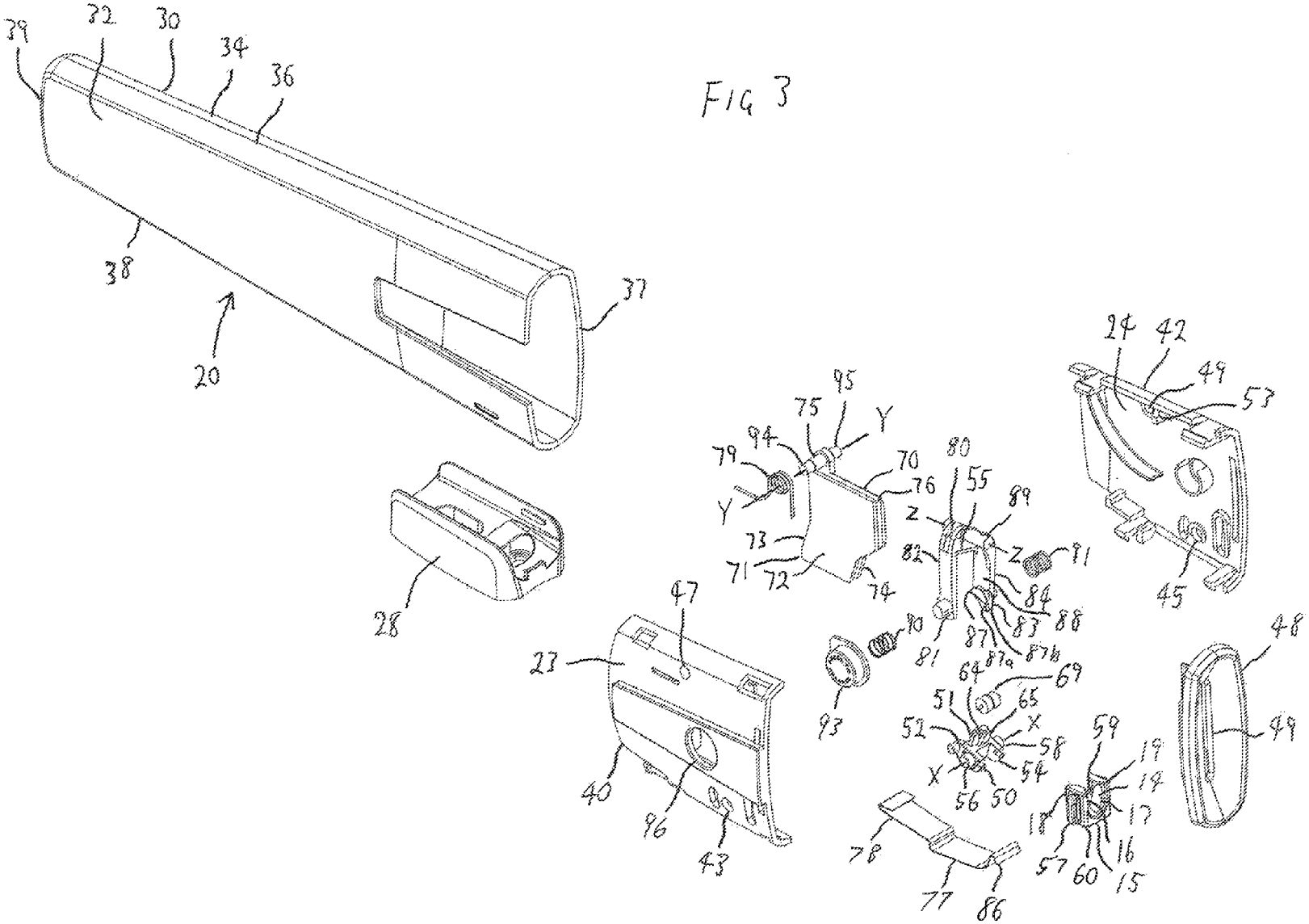
FIG. 3 illustrates an orthogonal exploded view of the blade scabbard of FIG. 1 illustrating the components of the blade scabbard including a blade sharpener and a blade honing device of the blade sharpening device.
Figure 4:
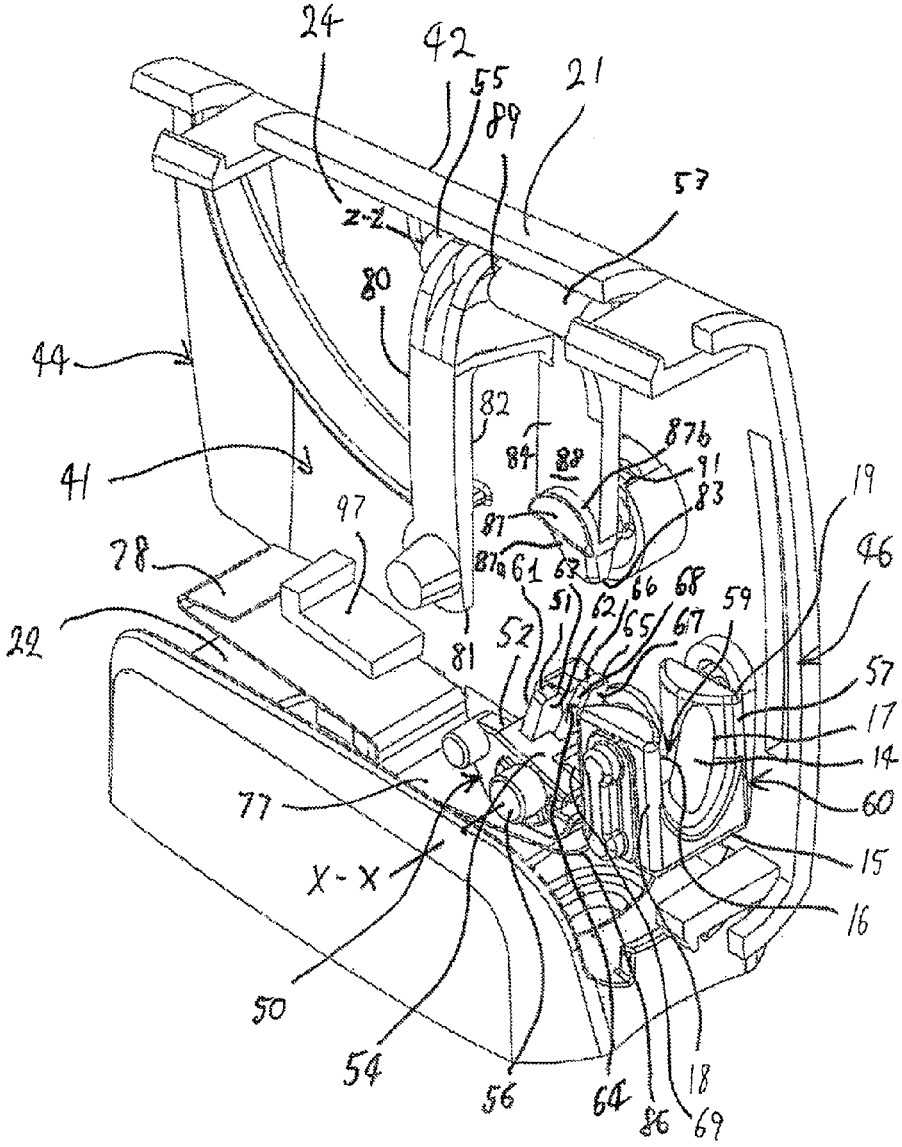
FIG. 4 illustrates an orthogonal cut away view of the blade sharpening device of FIG. 1 illustrating the components of the blade sharpening device including the blade sharpener and the blade honing device.

Also arranged within the housing 41 is a blade guide 70 which is shown in FIGS. 3 and 5. The blade guide 70 includes a pair of opposite guide surfaces 72, 74 defining a guide slot 76 therebetween. The guide slot 76 lies in a plane which runs in a vertical direction extending from bottom wall 22 to the top wall 21 of the housing 41 and in the longitudinal direction of insertion of the blade 5 within the housing 41. The guide surfaces 72, 74 include a pair of generally parallel plate members connected along one edge by an end plate 73. The end plate 73 has a lower free edge 71 and an upper edge 75. The blade guide 70 further includes a pair of transverse projections 94, 95 connected to the guide surfaces 72, 74 and the end plate 73 at the upper edge 75 thereof. The transverse projections 94, 95 are configured to be received within a pair of opposing slots 47, 49 within the opposing side walls 23, 24 of the housing 41 so as to enable the blade guide 70 to pivot about an axis Y-Y in a direction perpendicular to the guide slot 76 wherein the axis Y-Y runs in substantially in the same direction as the axis X-X.

The blade guide 70 further includes a blade guide biasing member 79 in the form of a helical torsion spring which is positioned around one of the transverse projections 94, 95 and is configured to bias the blade guide 70 to a generally downwardly extending position within the first and second housing members 40, 42. When the blade guide 70 is in the generally downwardly extending position the end plate 73 extends in a generally downwardly extending direction within the housing 41. In use, the blade guide 70 is configured such that upon insertion of the blade 5 through the access opening 49 the blade 5 is received within the guide slot 76 between the guide surfaces 72, 74 and the blunt edge 7 engages the generally downwardly extending end plate 73. Further insertion of the blade 5 into the housing 41 causes the blunt edge 7 to push the blade guide 70 in an arc range of motion about the axis Y-Y from a generally downwardly extending position, as shown in FIG. 3, to a generally forward extending position within the opening 73 of the main body 30 of the blade scabbard 20, as shown in FIG. 5.

When the blade guide 70 is in the forward extending position further insertion of the blade 5 within the housing 41 causes the blade 5 to slide within the guide slot 76 and into the opening 37 of the main body 30 of the scabbard 20. The biasing action of the blade guide biasing member 79 on the blade guide 70 tends to bias the blade guide 70 from the forward extending position to the downward extending position. When the blade 5 is positioned within the guide slot 76 the biasing action upon the blade guide 70 causes the end plate 73 of the blade guide 70 to engage the blunt surface 7 of the blade 5 opposite the cutting edge 4 to thereby bias the cutting edge 4 of the blade 5 into the sharpening recess 64 of the blade sharpener 50 and into the honing recess 59 of the honing device 60 upon insertion and withdrawal of the blade 5 into and from the housing 41.

As shown in FIGS. 1, 3 to 6, the blade sharpening device 10 and the blade 5 also include a blade restraining mechanism. The blade restraining mechanism consists of a restraining member 80 that is positioned within the housing 41 and also engages the opening 6 within the blade 5 and between the parallel sides 8, 9 of the blade 5. The restraining member 80 and the opening 6 within the blade 5 are configured, as will be described below, to enable the blade 5 to be selectively restrained in a position such that substantially the entire cutting edge 4 of the blade 5 is within the housing 41 and the main body 30 of the blade scabbard 20. The restraining member 80 has active and inactive positions and is movable relative to the housing 41 between the active and inactive positions. In the active position the restraining member 80 engages the opening 6 within the blade 5 to prevent withdrawal of the blade 5 and in the inactive position the restraining member 80 is disengaged from the opening 6 within the blade 5 to enable withdrawal of the blade 5.

Thus, the restraining member 80 and the opening 6 interact to prevent inadvertent withdrawal of the blade 5 from within the housing 41 of the sharpening device 10 and from within the main body 30 of the scabbard 20. Because the opening 6 is within the blade 5 the opening 6 is completely surrounded in the plane transverse to the longitudinal axis A-A of the opening 6 by the surface 11 which is integral with the rest of the blade 5. Although in the illustrated embodiments the opening 6 passes completely between the parallel sides 8, 9 of the blade 5 it is to be appreciated that the opening 6 may not necessarily pass completely through the blade 5 but may extend only part of the way between the parallel sides 8, 9 of the blade 5. However, even such an embodiment which is not illustrated in the Figures, the opening (not shown) still has a longitudinal axis which is substantially transverse to the parallel sides 8, 9 of the blade 5 and still has a surface (not shown) completely surrounding the opening (not shown) in a plane transverse to the longitudinal axis of the opening. In the embodiments illustrated the opening 6 is round and the surface 11 is annular, however, it is to be appreciated that the opening may be any suitable enclosed shape such as a square, rectangle, oval to name but a few examples.

An advantage of the fact the blade restraining mechanism incorporates the opening 6 within the blade 5 is that the overall structural integrity of the blade 5 is not compromised to any significant degree. This is in contrast to existing blade restraining mechanisms which incorporate notches or the like on either an upper or lower edge of the blade such as a concave notch in either the tang 1, the cutting edge 4, the blunt edge 7 or a portion of the blade 5 between the tang 1 and the cutting edge 4 adjacent to the handle 3. Such concave notches tend to significantly reduce the tensile strength of the blade 5 as well as, and perhaps more importantly, significantly reducing the ability of the blade 5 to resist shearing forces applied to the blade 5. For example, when the cutting edge 4 of the blade 5 is placed upon a piece of hard material to be cut and manual pressure is applied to the handle 3 in a downwards direction to force the cutting edge 4 of the blade 5 to cut through the hard material a shear strain is applied to the blade 5. The notch can provide a zone of weakness in the blade 5 which if the shear strain is sufficient can result in shearing and/or fracturing of the blade 5.

As shown in FIGS. 3 to 6 the restraining member 80 includes substantially parallel first and second arms 82, 84 which are spaced apart to define a blade 5 receiving gap 85 there between. The arms 82, 84 are connected by a web 55 at one end of the arms 82, 84. Each of the arms 82, 84 also has a respective free end 81, 83 opposite to the web 55. Thus the restraining member 80 is in the form of a generally inverted U-shaped member when mounted within the housing 41. A transverse axle 89 is mounted to the web 55. The axle 89 is configured to be received and mounted within an axle mount 53 in the form of an opening formed in the top wall 21 of the housing 41. The axle 89 is received within the mount 53 so as to facilitate pivoting of the restraining member 80 about an axis Z-Z wherein the axis Z-Z runs in the longitudinal direction of insertion of the blade 5 within the housing 41 of the sharpening device 10 from the rearward opening 46 to the opposing forward opening 44 of the housing 41. Thus, the arms 82, 84 of the restraining member 80 are configured to be able to pivot together from side to side within the housing 41 between an active position in which the arms 82, 84 extend in a generally downward direction and an inactive position in which the arms 82, 84 extend in a direction angularly displaced from the active position.

The free end 83 of the second arm 84 includes a projection 87 which extends from an inner surface 88 of the second arm 84 towards the opposite arm 82. The projection 87 includes a sloping surface 87*a* and a arched surface 87*b*. The sloping surface 87*a* of the projection 87 faces generally downwards towards the bottom wall 22 of the housing 41 and away from the top wall 21. The arched surface 87*b* of the projection 87 faces generally upwards towards the top wall 21 of the housing 41 and away from the bottom wall 22. The restraining member 80 further includes a pair of biasing members 90, 91 which are arranged to bias the restraining member 80 about the axis Z-Z to a resting position which is also the active position of the restraining member 80 wherein the projection 87 is positioned within a path of insertion of the blade 5 within the housing 41. Thus, upon insertion of the blade 5 through the access opening 49 and into the housing 41 the tip 2 of the blade 5 passes beneath the sloping surface 87*a* of the projection 87 and the blunt edge 7 of the blade 5 engages the sloping surface 87*a* of the projection 87 from beneath. As the blade 5 is inserted further into the housing 41 the cutting edge 4 of the blade 7 engages and is supported from beneath by the sharpening members 51, 65 the blunt edge 7 slides over the sloping surface 87*a* and simultaneously pushes the projection 87 aside thereby moving the restraining member 80 about the axis Z-Z towards the second side wall 24 which is also the inactive position of the restraining member 80. In other words, upon insertion into the housing the blade 5 pushes the second arm 84 and the projection 87 towards the second side wall 24, which corresponds to the inactive position, which enables the blade 5 to continue to be inserted through the access opening 49 and the housing 41 until the projection 87 meets the opening 6 within the blade 5. The opening 6 within the blade 5 is located at a position proximal to the handle 3 of the blade 5 such that when the projection 87 meets the opening 6 substantially the entire cutting edge 4 of the blade 5 is positioned within the housing 41 of the blade sharpening device 10 and within the main body 30 of the blade scabbard 20.

Once the blade 5 has been inserted such that the projection 87 meets the opening 6 within the blade 5 the biasing members 90, 91 are configured to bias the restraining member 80 about the axis Z-Z towards the first side wall 23 and towards the resting position which is also the active position thereof. Thus, when the projection 87 meets the opening 6 within the blade 5 the biasing members 90, 91 bias the projection 87 to a position within the opening 6 within the blade 5. When the projection 87 is received within the opening 6 the straight surface 87*b* of the projection 87 abuts against the surface 11 surrounding the opening 6 within the blade 5 to prevent withdrawal of the blade 5 from within the housing 41 of the sharpening device 10 and from within the main body 30 of the scabbard 20.

Thus, the restraining member 80 is configured to pivot from side to side in a direction transverse to the parallel sides 8, 9 of the blade 5 when the blade 5 is positioned within the housing 41. The restraining member 80 thereby engages the opening 6 within the blade 5 from a direction substantially transverse to the parallel sides 8, 9 of the blade 5. In one form, the restraining member 80 is configured to engage the opening 6 within the blade 5 by movement of the restraining member 80 in substantially the same direction as the longitudinal axis A-A of the opening 6. Thus, movement of the restraining member 80 between the active and inactive positions involves movement of the projection 87 in a direction substantially transverse to the parallel sides 8, 9 of the blade 5 when the blade 5 is positioned within the housing 41 between a position in which the projection 87 is within and engages the opening 6 within the blade 5 (active) and a position in which the projection 87 is outside and does not engage the opening 6 within the blade 5 (inactive). Furthermore, the biasing action of the biasing members 90, 91 is also in the direction substantially transverse to the parallel sides 8, 9 of the blade 5.

As shown in FIGS. 1 and 3, the restraining mechanism further includes a button 93 which fits within an opening 96 in the first side wall 23 of the housing 41 and which is arranged to engage the free end 81 of the first arm 82 of the restraining member 80. The button 93 is operable to be depressed manually within the opening 96. The button 93 is configured to be depressed in substantially the direction transverse to the parallel sides 8, 9 of the blade 5 when the blade is in the housing 41 which is also substantially the same direction as the longitudinal axis A-A of the opening 6 within the blade 5. Depressing the button 93 actuates the restraining member 80 about the axis Z-Z from the active position to the inactive position wherein the projection 87 is moved from within to outside the opening 6 within the blade 5. When the projection 87 is moved outside the opening 6 within the blade 5 the straight surface 87*b* no longer abuts the surface 7 surrounding the opening 6 within the blade 5 thereby enabling the blade 5 to be withdrawn from within the housing 41 and the main body 30 of the blade scabbard 20 for subsequent use of the blade 5. Releasing the button 93 enables the biasing members 90, 91 to bias the restraining member 80 about the axis Z-Z from the inactive position to the active position so that upon subsequent reinsertion of the blade 5 the restraining member 80 is positioned to lock the blade 5 therewithin.

Figure 7:
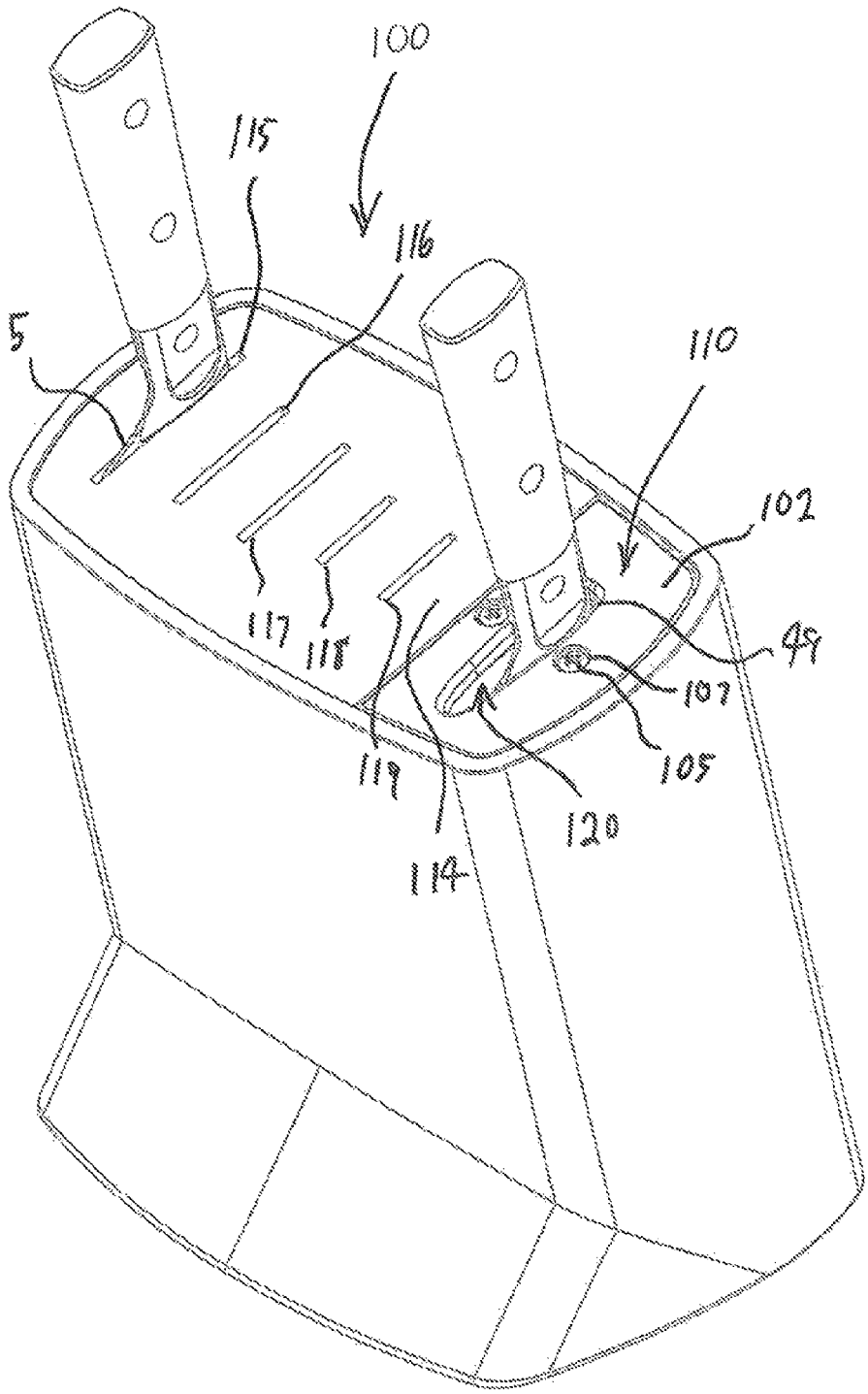
FIG. 7 illustrates an orthogonal view of a knife block including a plurality of openings for receiving one or more knife blades therewithin and a blade sharpening device in accordance with another preferred form of the invention with a blade of a knife inserted within the blade sharpening device and the blade of another knife inserted within one of the openings.
Figure 8:
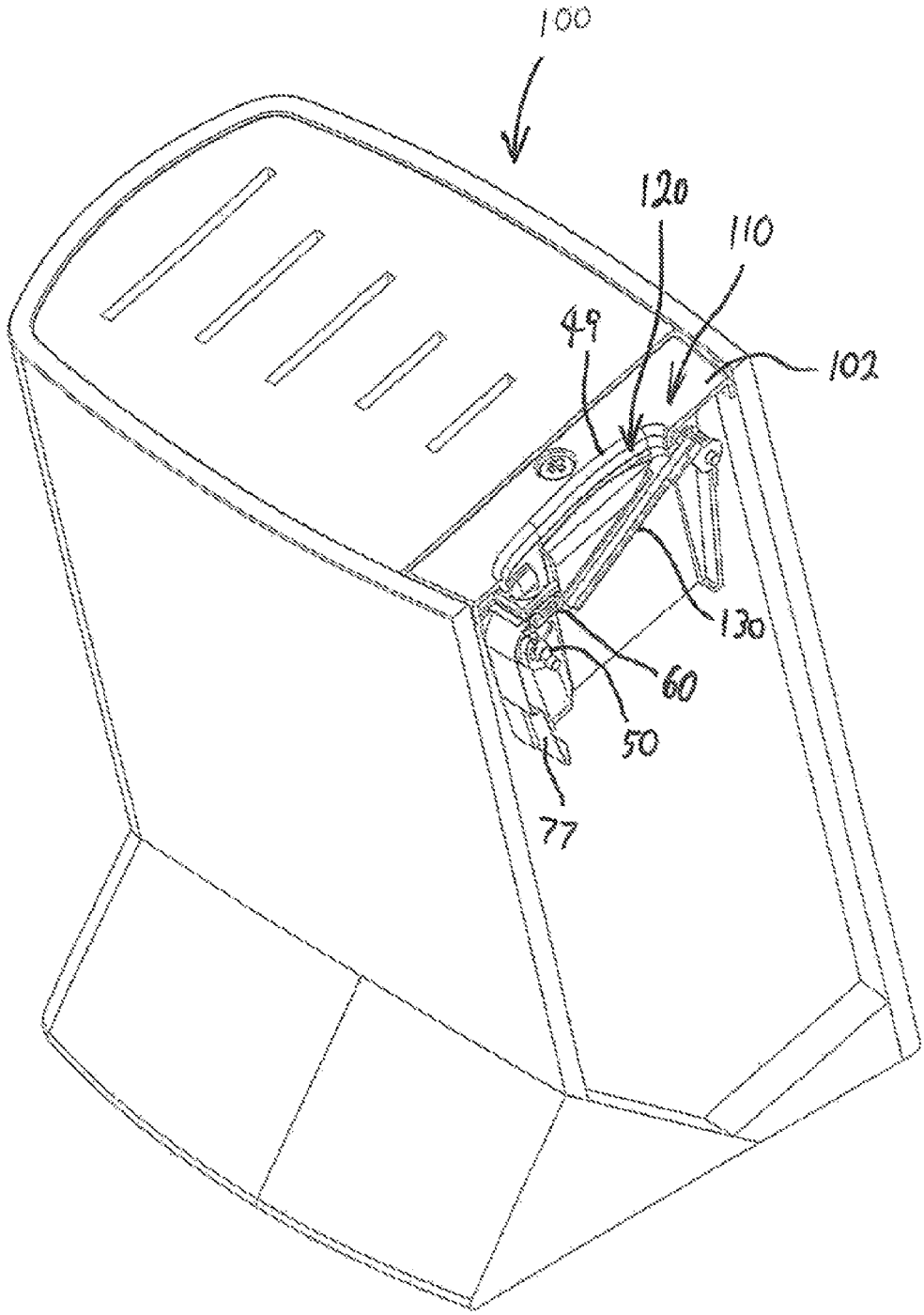
FIG. 8 illustrates a cut away orthogonal view of the knife block of FIG. 7 illustrating the components of the blade sharpening device including the blade sharpener and the blade honing device.
Figure 9:
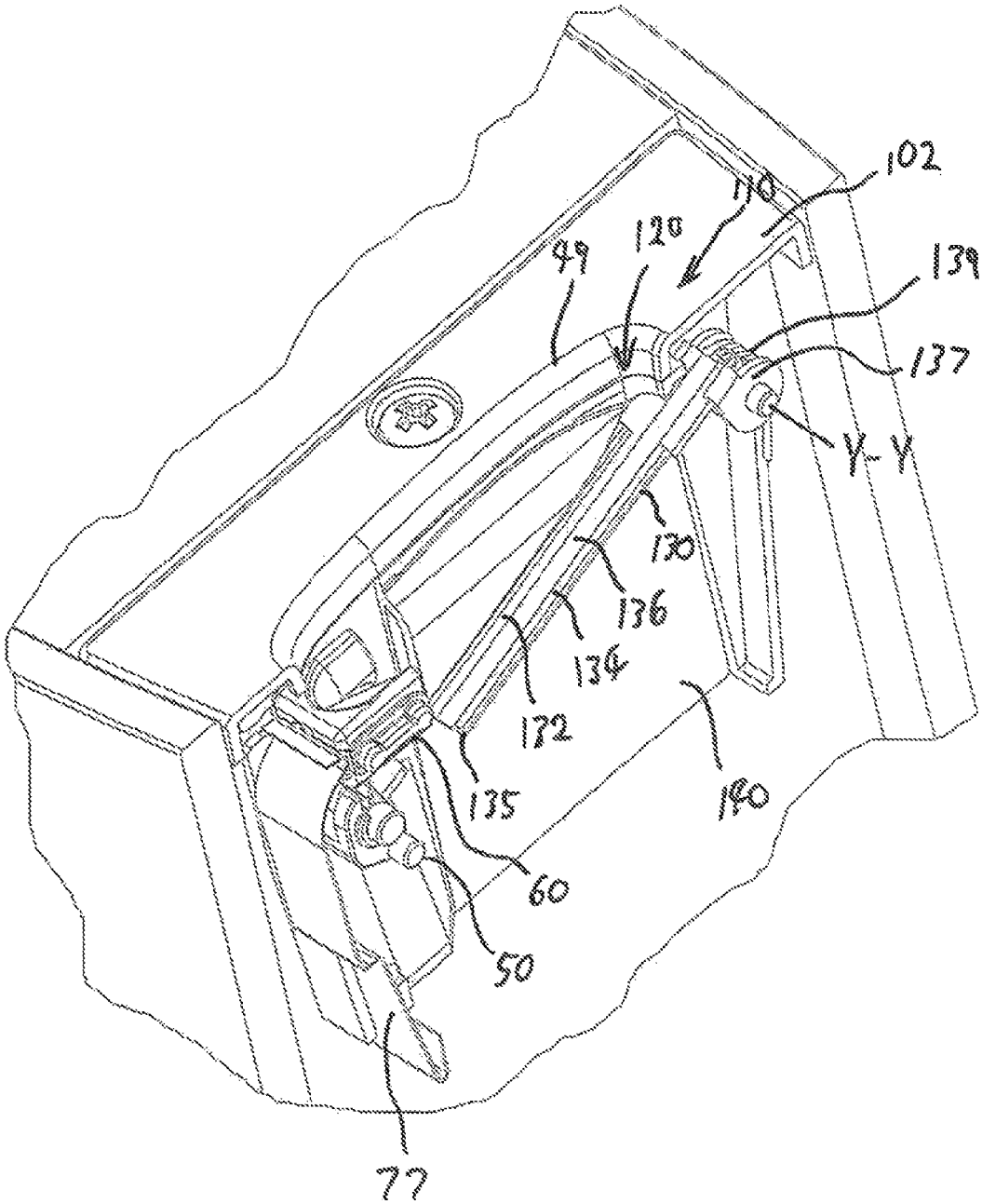
FIG. 9 illustrates an enlarged view of a portion of the cut away orthogonal view of FIG. 8 of the knife block of FIG. 7 illustrating the components of the blade sharpening device including the blade sharpener and the blade honing device.

FIGS. 7 to 9 illustrate another embodiment of the blade sharpening device 110 in the form of a sharpening cassette is adapted to be mounted within a blade storage device or blade holder in the form of a knife block 100. In respect of both embodiments of the blade sharpening device 10, 110 like reference numerals are used herein in respect of like components. The knife block 100 incorporates one or more openings 115, 116, 117, 118, 119 for receiving one or more knife blades 5 therewithin. The knife block 100 further includes a sharpener opening 120 for receiving the blade sharpening device 110 therewithin. The blade sharpening device 110 includes a housing 140 mounted to the sharpener opening 120 such that the access opening 49 is located substantially adjacent to a facing surface 114 of the knife block 100. The blade sharpening device 110 is affixed within the sharpener opening 120 by any suitable means. In the embodiments illustrated in FIGS. 7 to 9 the blade sharpening device 110 is affixed within the sharpener opening 120 by one or more fasteners 105, in the form of screws, which are inserted through a respective fastener opening 107 of a facing plate 102 surrounding the access opening 49 of the blade sharpening device 110. Thus, the facing plate 102 is configured to be mounted substantially flush with the facing surface 114 of the knife block 100. It is possible to remove the blade sharpening device 110 from within the sharpener opening 120 of the knife block 100 so that the blade sharpening device can be cleaned or otherwise serviced or maintained. Removal of the blade sharpening device 110 is achieved by removing the fasteners 105 from within their respective fastener openings 107 and removing the facing plate 102 surrounding the access opening 49 of the blade sharpening device 110. With the facing plate 102 removed, it is possible to remove the blade sharpening device 110 from within the sharpener opening 120. Once the blade sharpening device 110 has been cleaned or otherwise serviced or maintained it can be replaced in the sharpener opening 120 and then the facing plate 102 reattached by reinsertion of the fasteners 105 within their respective fastener openings 107. The blade sharpening device 110 is substantially similar in most respects to the embodiment of the blade sharpening device 10 incorporated into the blade scabbard 20 described and illustrated above with the exception that the blade sharpening device 110 may exclude the feature of the restraining mechanism.

The blade sharpening device 110 includes the blade sharpener 50 and the honing device 60. However, the blade sharpener 50 includes a different form of a blade guide 130 which is shown in FIGS. 8 and 9. The blade guide 130 includes a pair of opposite guide surfaces 132, 134 defining a guide slot 136 therebetween. The blade guide 130 includes a free end 135 and an opposite connecting end 137 pivotally connected to the housing 140 to enable the blade guide 130 to pivot about the axis Y-Y in a direction perpendicular to the guide slot 136 wherein the axis Y-Y runs in substantially in the same direction as the axis X-X. A torsion spring 139 is mounted to the connecting end 137 and is configured to bias the blade guide 130 to a position generally blocking the access opening 49. When the blade guide 130 is in this position, in use, the blade guide 130 is configured such that upon insertion of the blade 5 through the access opening 49 the blade 5 is received within the guide slot 136 between the guide surfaces 132,134 and the blunt edge 7 engages the generally guide slot 136. Further insertion of the blade 5 into the housing 140 causes the blunt edge 7 to push the blade guide 130 in an arc range of motion about the axis Y-Y from a position blocking the access opening 49 to a generally inward extending position within the sharpener opening 120 of the knife block 100.

When the blade guide 130 is in the inward extending position further insertion of the blade 5 within the sharpener opening 120 causes the blade 5 to slide within the guide slot 136 and into the sharpener opening 120. The biasing action of the torsion spring 139 on the blade guide 130 tends to bias the blade guide 130 from the inward extending position to the position blocking the access opening 49. When the blade 5 is positioned within the guide slot 136 the biasing action upon the blade guide 130 causes the guide slot 136 to engage the blunt surface 7 of the blade 5 opposite the cutting edge 4 to thereby bias the cutting edge 4 of the blade 5 into the sharpening recess 64 of the blade sharpener 50 and into the honing recess 59 of the honing device 60 upon insertion and withdrawal of the blade 5 into and from the sharpener opening 120.

A blade sharpener and blade storage device or blade holder combination such as the blade sharpener and scabbard combination or the blade sharpener and knife block combination as described above is safe and convenient to use. Furthermore, the blade sharpener and blade honing device is effective for both sharpening and honing the cutting edge of the blade upon insertion and/or removal of the blade from within the sharpener and scabbard or knife block. The blade restraining mechanism is also advantageous in preventing inadvertent withdrawal of the blade from within a blade storage or holder device, such as the blade sharpener and scabbard, unless deliberate finger pressure is applied to the release button to facilitate removal of the blade from within the sharpener and the scabbard for subsequent use of the blade. Furthermore, the opening within the blade along with the other components of the restraining mechanism described herein facilitates an effective and reliable means for restraining the blade within the blade storage or holder device in the form of the blade sharpener and scabbard.

Various alterations, modifications and/or additions may be introduced into the constructions and arrangements of parts previously described without departing from the spirit or ambit of the invention as defined by the appended claims.

The invention claimed is:

1. A blade storing device including:

a hollow housing for receiving and storing a blade;

an access opening at an end of the housing through which the blade can be moved longitudinally to be inserted into or withdrawn from the housing;

a blade sharpener pivotally mounted within the housing and positioned to be engaged by a cutting edge of the blade when the blade is inserted into or withdrawn from the housing and which is responsive to movement of the blade relative to the housing to sharpen the cutting edge; and a blade honing device positioned within the housing to be engaged by the cutting edge of the blade when the blade is inserted into or withdrawn from the housing and which is responsive to movement of the blade relative to the housing to hone the cutting edge, wherein the blade honing device is mounted within the housing and is biased by a spring to cause engagement between the cutting edge of the blade and the honing surface.

2. The blade storing device of claim 1, wherein the blade honing device is positioned relative to the blade sharpener so as to hone a portion of the cutting edge blade after the sharpener sharpens the portion of the cutting edge of the blade upon withdrawal of the blade from the housing.

3. The blade storing device of claim 1, wherein the honing device includes a pair of honing members each having a honing surface and being arranged so that there is an overlap between the honing surfaces and a generally v-shaped honing recess formed between the two honing surfaces for receiving the cutting edge of the blade wherein said honing surfaces are operative to hone the cutting edge of the blade upon movement of the blade within the honing recess relative to the honing surfaces.

4. The blade storing device of claim 3, wherein the honing members are arranged in substantially parallel relationship and the honing surfaces are curved in transverse cross section.

5. The blade storing device of claim 3, wherein the honing device includes a honing support member supporting the honing members, the honing support member is mounted to the housing to be movable in a linear direction vertically upwards within the housing and is biased by the spring in the vertically upwards direction so that upon movement of the blade relative to the housing the cutting edge of the blade is maintained within the honing recess and in engagement with the honing surfaces.

6. The blade storing device of claim 1, further including a blade restraining mechanism that includes a restraining member movably coupled to the housing and engageable with an opening within the blade, the restraining member being movable relative to the housing between active and inactive positions in that when the blade is inserted within the housing such that substantially the entire cutting edge of the blade is within the housing, in the active position the restraining member is positioned inside the opening within the blade for preventing withdrawal of the blade from the housing and in the inactive position the restraining member is positioned outside the opening within the blade for allowing withdrawal of the blade from the housing.

7. The blade storing device of claim 6, wherein the restraining member is biased by a second spring towards the active position and is configured so that during insertion of the blade into the housing the blade engages and actuates the restraining member to the inactive position until the blade is inserted sufficiently within the housing such that the opening meets the restraining member which is then biased to the active position.

8. The blade storing device of claim 6, wherein the restraining member includes a projection which extends transversely to a direction of insertion of the blade into the housing and has a arched surface and an opposite sloping surface, wherein the sloping surface is engaged by the blade upon insertion into the housing and wherein the arched surface engages the opening within the blade when the restraining member is in the active position to prevent withdrawal of the blade from the housing.

9. The blade storing device of claim 6, wherein the second spring is in communication with a button that extends through a hole in the housing so that the restraining mechanism is operable by hand to actuate the restraining member from the active position to the inactive position.

10. The blade storing device of claim 1, wherein the blade sharpener includes a pair of sharpening members each having a pair of opposite front and rear surfaces and a transverse surface extending between and meeting the front and rear surfaces, the sharpening members being arranged to overlap to form a generally v-shaped sharpening recess between the transverse surfaces for receiving the cutting edge of the blade wherein each of the transverse surfaces meets at least one of the front and rear surfaces at a sharp corner wherein the sharp corner is operable to sharpen the cutting edge of the blade upon movement of the blade within the sharpening recess relative to the sharpening members.

11. The blade storing device of claim 1, further including a biased blade guide that is configured to receive the blade upon insertion into the housing, the blade guide is configured to bias the cutting edge of the blade into engagement with the blade sharpener and the blade honing device when the blade is inserted into or withdrawn from the housing.

12. The blade storing device of claim 1, wherein the housing is incorporated in a blade scabbard.

13. The blade storing device of claim 1, wherein the honing device is positioned between the blade sharpener and the access opening.

14. The blade storing device of claim 1, wherein the housing is incorporated in a knife block.

* * * * *